US011097135B2

(12) United States Patent
Sim et al.

(10) Patent No.: US 11,097,135 B2
(45) Date of Patent: Aug. 24, 2021

(54) ROPE TYPE ELEVATING DEVICE

(71) Applicant: Koduct Co., Ltd., Busan (KR)

(72) Inventors: Sung Soo Sim, Busan (KR); Woo Jun Lee, Busan (KR); Byung Mu Kang, Busan (KR)

(73) Assignee: KODUCT CO., LTD., Busan (KR)

( * ) Notice: Subject to any disclaimer, the term of this patent is extended or adjusted under 35 U.S.C. 154(b) by 92 days.

(21) Appl. No.: 16/616,415

(22) PCT Filed: Dec. 21, 2017

(86) PCT No.: PCT/KR2017/015186
§ 371 (c)(1),
(2) Date: Nov. 22, 2019

(87) PCT Pub. No.: WO2018/216867
PCT Pub. Date: Nov. 29, 2018

(65) Prior Publication Data

US 2020/0179731 A1 Jun. 11, 2020

(30) Foreign Application Priority Data

May 26, 2017 (KR) ..... 10-2017-0064975

(51) Int. Cl.
*A62B 1/10* (2006.01)
*B66D 5/16* (2006.01)
*B66D 5/24* (2006.01)

(52) U.S. Cl.
CPC ..... *A62B 1/10* (2013.01); *B66D 5/16* (2013.01); *B66D 5/24* (2013.01)

(58) Field of Classification Search
CPC .... A62B 1/06; A62B 1/10; A62B 1/12; A62B 1/14; B66D 5/16; B66D 5/08; B66D 5/20; B66D 1/7489; B66D 3/04; B66D 3/10
See application file for complete search history.

(56) References Cited

U.S. PATENT DOCUMENTS 387,650 A * 8/1888 Lovejoy ..... A62B 1/14 188/65.2
4,474,262 A * 10/1984 Himmelrich ..... A62B 1/14 182/5

(Continued)

FOREIGN PATENT DOCUMENTS

CN 2176805 Y 9/1994
CN 1281737 A 1/2001

(Continued)

OTHER PUBLICATIONS

KIPO, Office Action for Korean Application No. 10-2017-0064975, dated Feb. 20, 2018, 5 pages.

(Continued)

*Primary Examiner* — Emmanuel M Marcelo
(74) *Attorney, Agent, or Firm* — Stetina Brunda Garred and Brucker

(57) ABSTRACT

The present invention relates to a rope type elevating device, and more particularly, to a rope type elevating device that can mechanically and safely control the falling speed even if a breakage occurs in the brake being electrically controlled during the elevating and descending operation.
The rope type lifting device of the present invention comprising an electronic braking device for winding a conveying rope to move the rope up and down by using power, and a mechanical braking device for mechanically moving the conveying rope up and down, characterizes in that the mechanical braking device comprises: an unlocking lever being rotated by an external force within a predetermined rotation range; a connecting portion connected to the unlocking lever and moving forward by a predetermined amount in conjunction with the rotation of the unlocking lever; a rotating body that rotates by the amount of advancement of the connecting portion and adjusts a pressing force applied to the conveying rope; and a stopper for limiting the (Continued)

rotation range of the rotating body and supporting the pressing force applied to the rope by the rotating body.

4 Claims, 5 Drawing Sheets

(56) References Cited

U.S. PATENT DOCUMENTS

| | | | | |
|---|---|---|---|---|
| 4,576,248 | A * | 3/1986 | Marom | A62B 1/14 182/5 |
| 4,632,218 | A * | 12/1986 | Hannan | A62B 1/14 182/5 |
| 5,402,985 | A * | 4/1995 | Owens | B63B 21/16 254/333 |
| 6,059,266 | A * | 5/2000 | Ascherin | B64D 1/22 242/397.5 |
| 6,283,455 | B1 * | 9/2001 | Ascherin | B64D 1/22 242/397.5 |
| 6,412,602 | B1 * | 7/2002 | Sundman | A62B 1/14 182/133 |
| 6,685,171 | B2 * | 2/2004 | Lob | B66D 3/06 254/391 |
| 6,814,185 | B1 * | 11/2004 | Ostrobrod | A62B 1/14 182/191 |
| 9,427,606 | B2 * | 8/2016 | Ball | A62B 1/06 |
| 9,850,113 | B2 * | 12/2017 | Melin | B66D 3/20 |
| 2005/0039981 | A1 * | 2/2005 | Wooster | A62B 1/10 182/75 |
| 2006/0017047 | A1 * | 1/2006 | Calver | B66D 1/7415 254/411 |
| 2008/0203370 | A1 * | 8/2008 | Ball | B66D 1/7489 254/372 |
| 2014/0299411 | A1 * | 10/2014 | Aldred | A62B 1/14 182/5 |
| 2017/0001055 | A1 * | 1/2017 | Brown | A63B 29/02 |

FOREIGN PATENT DOCUMENTS

| | | | |
|---|---|---|---|
| GB | 2086547 | B | 9/1984 |
| KR | 1985-0002861 | | 12/1985 |
| KR | 850002861 | Y1 | 12/1985 |
| KR | 1998-026059 | | 8/1998 |
| KR | 20-0360258 | | 8/2004 |
| KR | 200360258 | Y1 | 8/2004 |
| KR | 200413166 | Y1 | 4/2006 |
| KR | 20100107539 | | 10/2010 |
| KR | 101026277 | B1 | 3/2011 |
| KR | 101311643 | | 9/2013 |
| KR | 20160012638 | | 2/2016 |
| KR | 20160012638 | A | 2/2016 |

OTHER PUBLICATIONS

CNIPA, Office Action and Search Report for corresponding Chinese Application No. CN201780091217, dated Sep. 24, 2020, 8 pages.

* cited by examiner

ROPE TYPE ELEVATING DEVICE

CROSS-REFERENCE TO RELATED APPLICATIONS

This application is the National Phase of PCT International Application No. PCT/KR2017/015186, filed on Dec. 21, 2017, which claims priority under 35 U.S.C. 119(a) to Patent Application No. 10-2017-0064975, filed in the Republic of Korea on May 26, 2017, all of which are hereby expressly incorporated by reference into the present application.

STATEMENT RE: FEDERALLY SPONSORED RESEARCH/DEVELOPMENT

Not Applicable

TECHNICAL FIELD

The present invention relates to a rope type elevating device, and more particularly, to a rope type elevating device that can mechanically and safely control the descending speed even if a breakage occurs in the brake being electrically controlled during the elevating and descending operation.

BACKGROUND ART

There are many high-rise buildings with more than 15 stories in the country, and when a fire broke out in such high-rise buildings, it is difficult to extinguishing the fire quickly with current domestic fire-fighting devices or fire-fighting technologies.

Therefore, when a fire breaks out in a high-rise building, various methods for evacuating people have been coming to the fore, and one of them is a lifting device using a rope.

A rope type elevating device is an engine type power elevating device, which is used for escaping a person using a rope or a wire when a dangerous situation occurs.

The rope type elevating device helps a person escape from a fire site to a safe place by using a rope when a dangerous event such as a fire occurs in a high-rise building such as a high-rise apartment, a building, and the like. This is when a person is suspended from the rope of the rope-type lifting device, the rope is gradually descended to the ground and moved to a safe place to escape.

For example, in Utility Model Publication No. 1998-026059, a structure of a descending life line comprising: a loop; a pulley for winding the loop up; a reduction unit for reducing the rotational speed of the pulley; a coupling plate for coupling the loop, the pulley, and the reduction unit; a cover plate coupled to the upper direction of the coupling plate; and the like, is disclosed.

In addition, in U.S. Pat. No. 1,311,643, a configuration is disclosed wherein by applying the deceleration effect on the V-type brake first, the decelerating wheel feels the same load as if an underweight person is suspended even when an overweight person is suspended, so that the overweight person can descend with a low speed like the underweight person, and since the V-type brake accounts for a part of the weight of an evacuator, the fatigue of other parts of a descending life line is reduced, so that the descending life line can be used for a long time.

However, the descending life line is installed only in buildings less than 10 stories, when an actual fire occurs, they do not know how to use, and due to negligence in management, the frequency of use is extremely low, and therefore, most of them are rescued by firefighters and other firefighting equipment.

At this time, rescue methods by firefighters or firefighting equipment are largely divided into methods using elevated ladder trucks and rope methods by firefighters, and the elevated ladder trucks face many difficulties (illegal parking, spacing between buildings, and characteristics of the building structures) in approaching of the vehicles due to the domestic building structure and features, and due to these reasons, it requires a lot of time and is often difficult to respond to urgent rescue situations.

In addition, the rescue method using a rope mainly uses a rope or a reel, and hands must be used to descend and stop, it requires a considerable muscle strength and risk of danger.

However, since the method using a rope or reel has the advantage of convenient conveying and use of equipment, it is widely used in other rescue sites.

For example, a tripod reel is used at a manhole fall accident site, in this case there is a disadvantage in that several people must support the tripod reel, in addition, although reels are used to rescue the victims at a mountain rescue site, at this time also, a considerable muscle strength is required for the rescue personnel and there is a difficulty in that at least two or three people must pull to lift the injured.

DETAILED DESCRIPTION OF THE INVENTION

Technical Problems

The present invention has been devised to overcome the disadvantages of the prior art as described above, an object of the present invention is to provide a rope type lifting device that can quickly lift and descend a user by using the driving force of a motor or an engine.

In addition, another object of the present invention to provide a rope type lifting device that can safely control the descending speed even if the brake being electrically controlled during the lifting and descending operation is damaged.

Technical Solution

In order to solve the above technical problem, in a rope type lifting device comprising an electronic braking device for winding a conveying rope to move the rope up and down by power, and a mechanical braking device for mechanically moving the conveying rope up and down, wherein the mechanical braking device comprises an unlocking lever rotated by an external force within a predetermined rotation range; a connecting portion connected with the unlocking lever and moving forward by a predetermined amount in conjunction with the rotation of the unlocking lever; a rotating body that rotates by the amount of moving forward of the connecting portion and adjusts a pressing force applied to the conveying rope; a stopper limiting the rotation range of the rotating body and supporting the pressing force applied to the rope by the rotating body.

Preferably, it is characterized in that the unlocking lever forms a slot in a lengthwise direction, and configured to be movable the unlocking lever up and down within the lengthwise direction of the slot.

Preferably, it is characterized in that the stopper is configured a shape of passing a rope, and configured to press the rope passing the stopper by the rotating body.

Preferably, it is characterized in that the rotating body is reciprocally rotated in conjunction with a rotational operation of the unlocking lever within the rotation range limited by the stopper.

ADVANTAGEOUS EFFECTS OF INVENTION

The rope type elevating device according to the present invention constitutes a double safety device so that even if a problem occurs in the electronic braking device, the elevating operation can be performed using the mechanical braking device. In particular, since the rope type elevating device of the present invention can be used in dangerous situations, such as high buildings and fires, it can be used very efficiently to move people to a safe place by configuring the rope to be conveyed up and down through a mechanical control even in the situation where an electrical control is impossible.

DETAILED DESCRIPTION OF EMBODIMENTS

Figure 1:
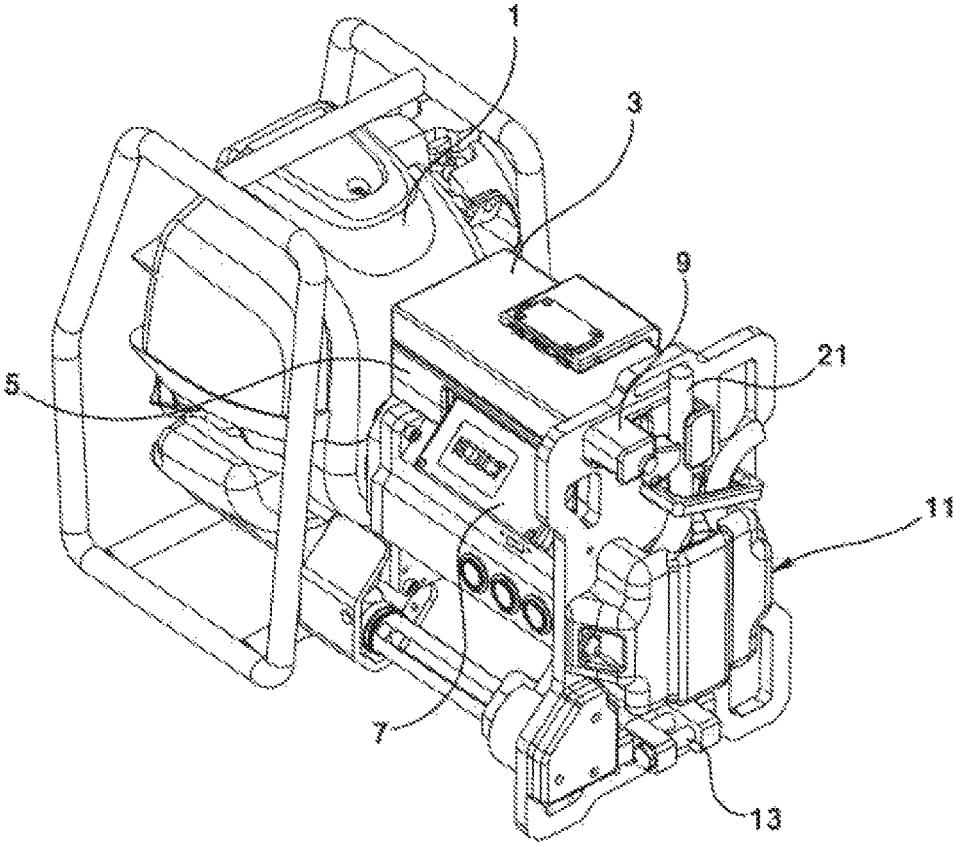
FIG. 1 is an overall perspective view of the rope type lifting device according to the present invention seen from the left side.

Hereinafter, embodiments disclosed herein will be described in detail with reference to the accompanying drawings, and the same or similar components will be given the same reference numerals regardless of the symbols of the drawings, and duplicated descriptions thereof will be omitted. The suffix "part" "member" for the components used in the following description is given only in consideration of ease of preparation of the specification and does not have any meaning or role in itself.

In addition, in the following description of the embodiments of the present invention, a detailed description of related arts will be omitted when it is determined that the gist of the embodiments disclosed herein may be blurred. Also, it is to be understood that the accompanying drawings are merely to provide a further understanding of the embodiments disclosed in this specification, and the technical spirits disclosed in this specification shall not be limited by the accompanying drawings, and that all changes, equivalents, and alternatives falling within the spirit and technical scope of the present invention are included.

Terms including ordinals, such as first, second, etc., may be used to describe various elements, but the elements are not limited to these terms. The terms are used only for the purpose of distinguishing one element from another.

It is to be understood that when an element is referred to as being "connected" or "coupled" to another element, it may be directly connected or coupled to the other element, on the other hand, when an element is referred to as being "directly connected" or "directly coupled" to another element, it should be understood that there are no other elements in between.

The singular expressions include plural expressions unless the context clearly dictates otherwise.

In the present application, the terms "comprises", "having", and the like are intended to specify the presence of stated features, numbers, steps, operations, elements, components, or combinations thereof, but do not preclude the presence or addition of one or more other features, numbers, steps, operations, elements, components, or combinations thereof.

Hereinafter, embodiments of the present invention will be described in detail with reference to the drawings. It will be apparent to those skilled in the art that the present invention may be embodied in other specific forms without departing from the spirit or essential characteristics thereof.

Figure 2:
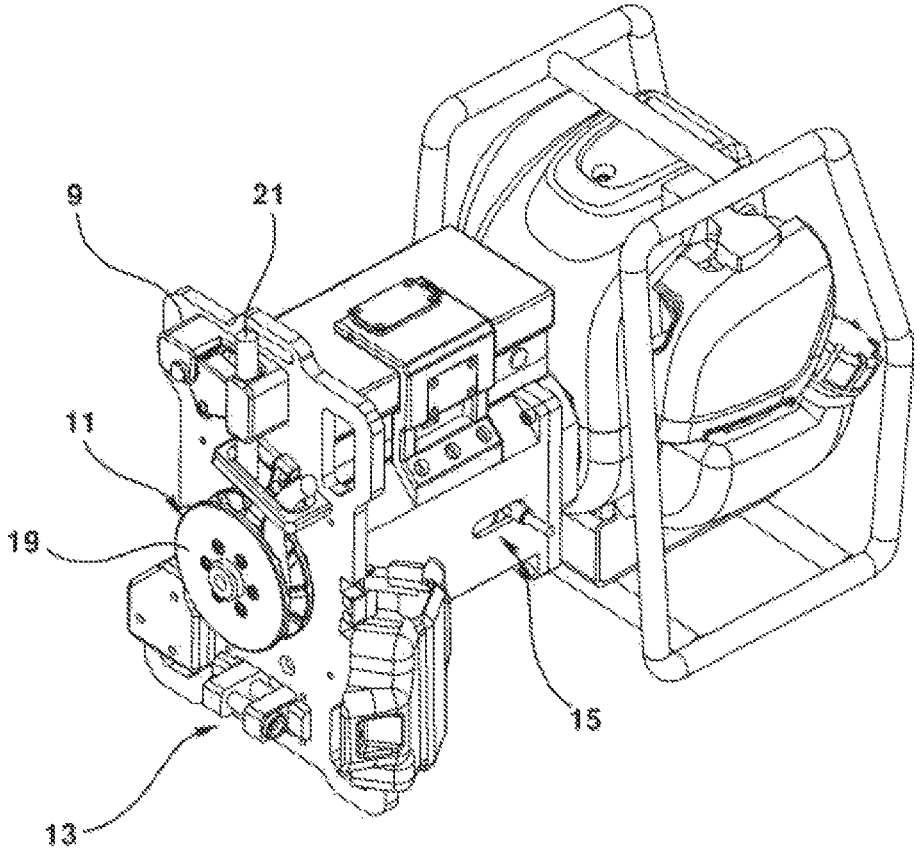
FIG. 2 is an overall perspective view of the rope type lifting device according to the present invention seen from the right side.

FIG. 1 shows an overall perspective view of the rope type lifting device according to the present invention seen from the left side. And FIG. 2 shows an overall perspective view of the rope type lifting device according to the present invention seen from the right side.

The rope type elevating device of the present invention is a device which directly mounts an engine or a motor in a drive unit 1 and safely lifts or descends a load within a predetermined weight range by the generated power of the engine. The drive unit 1 includes a prime mover, a clutch and a brake connected to the rotating shaft of the prime mover.

The prime mover is implemented as a motor or an engine, and when a strong driving force is required, an engine is applied, and for the convenience of usage and when transferring a relatively small weight, it is preferable to be implemented as a motor.

Preferably, the clutch and the brake are configured to operate by a control module 5, which will be described later, by applying an electronic type, and it is configured to include a configuration wherein the control module 5 performs the operation of the clutch and the brake by a user's manipulation, if it is necessary.

The rope type lifting device of the present invention includes a rope drum 19 which is connected to the output shaft of the drive unit 1 and rotates, and the rope drum 19 wound up with a rope 21 for lifting or descending the rope type lifting device of the present invention. The rope drum 19 is a pulley structure formed with a V groove on the side surface, if necessary, a step and the like is formed on the inner surface of the pulley groove to increase the friction with the rope 21.

Therefore, the rope 21 is wound around the rope drum 19, the rope drum 19 is rotated by the driving force of the drive unit 1 to lift or descend the rope type lifting device of the present invention.

The rope type elevating device of the present invention operating as described above is equipped with a double safety device including an electronic braking device 15 and a mechanical braking device 9. The electronic braking device 15 is configured to be controlled by the control module 5.

The electronic braking device 15 is configured to electrically control the clutch and the brake in the drive unit 1 to control the lifting and descending and the stopping operation of the rope type elevating device of the present invention.

The electronic braking device 5 is equipped with a function of limiting the weight to be loaded, and a function of limiting the speed for preventing sudden descending. In the embodiment of the present invention, the maximum allowable weight is 250 kg, but a suitable weight for lifting and descending is preferably within 120 kg. In addition, the maximum lifting speed of 0.26 m/s and the maximum descending speed of 0.3 m/s are appropriate when it is lifted and descended through the electronic braking device 5, respectively. The lifting speed and the descending speed are examples when the loaded weight is 120 kg.

The control module 5 receives a detection signal and the like from a load sensing device 13 for detecting the weight of the load loaded on the rope type lifting device using a load cell and the like, a descending speed measuring device 11 for measuring the speed and direction using a magnetic sensor and the like, and an RFID module 7, thereby generating a signal for controlling the lifting, descending, and stop operation of the electronic braking device 15

In addition, the rope type elevating device of the present invention further comprises a battery 3 for supplying power to the electric devices requiring electricity including the control module 5 and the electronic braking device 15.

Therefore, the control module 5 controls the lifting and descending movement operation of the rope type elevating device of the present invention at an appropriate speed through the electronic braking system 15 based on the detection signal of the load sensing device 13 and the descending speed measuring device 11. At this time, the control module 5 can also perform a control to decelerate the speed based on the detection value of the descending speed measuring device 11 when being lifted at a certain speed or above.

Meanwhile, the mechanical braking device 9 is a mechanical control structure capable of conveying the rope type elevating device up and down without using the electronic braking device 5. Therefore, the mechanical braking device 9 mechanically adjusts the lifting and descending in an emergency situation, such as breakage of the braking function of the electronic braking device 5.

Figure 3:
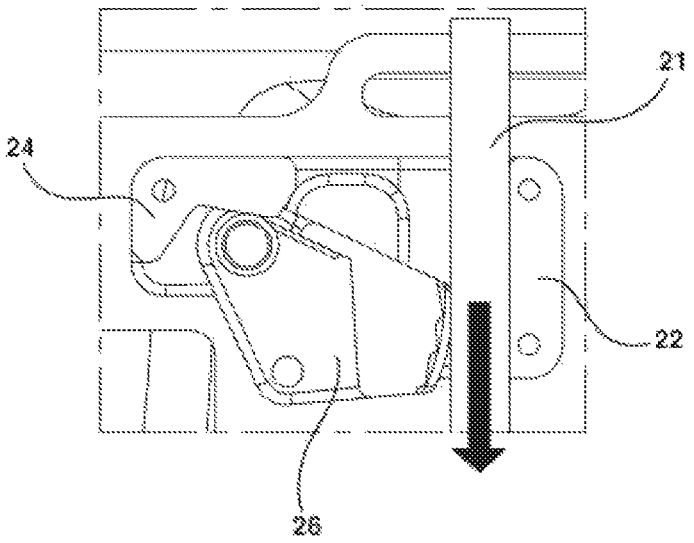
FIGS. 3 and 4 are configuration diagrams for explaining the mechanical braking device in the rope type lifting device according to the present invention.
Figure 4:
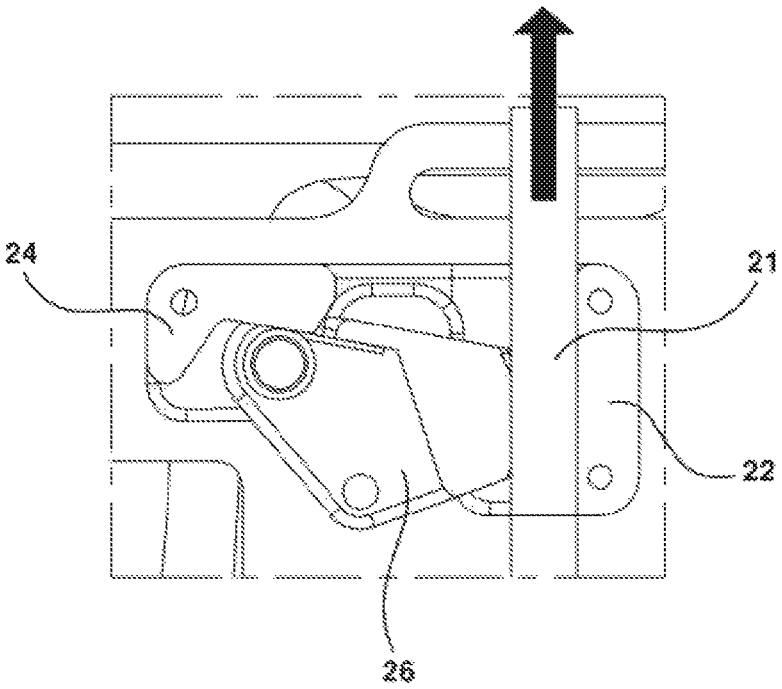

FIGS. 3 and 4 show the brake state imparted to the conveying rope during the lifting and descending operations of the conventional mechanical braking device.

A mechanical braking device illustrated comprises a support part 22 for passing the conveying rope, a rotating body 26 for pressing a rope 21 to limit the movement of the rope 21 passing through the support part 22, a stopper 24 for limiting the rotation of the rotating body 26 in the upward direction.

According to this configuration, as illustrated in FIG. 3, in order for the rope type elevating device to be lifted, the rope 21 must be moved in the direction of the arrow. At this time, in the portion wherein a rotating body 25*a* is engaged with the rope 21, a sawtooth shape is formed uniformly downward. Therefore, when the rope 21 is moved from the upper side to the lower side, it is not limited by the rotating body 25*a*.

However, as illustrated in FIG. 4, in order for the rope type lifting device to descend, the rope 21 must be moved from the lower side to the upper side. At this time, if the movement of the rope 21 is free, the person suspending in the air with the rope type lifting device may fall to the ground in a moment and thereby may cause a very dangerous situation.

Therefore, the rope type elevating device of the present invention is configured such that the movement of the rope 21 from the lower side to the upper side automatically becomes very limited in an emergency situation in which the electronic braking device is broken. That is, the rotation toward the upper side of the rotating body 25*a* is limited by the stopper 24, and the pressing force applied to the rope 21 by the rotating body 25*a* is in the maximum state. And the sawtooth shape uniformly formed in the downward direction to the portion in which the rotating body 25*a* and the rope 21 is engaged has an effect of further suppressing the movement of the rope 21 from the lower side to the upper side.

In this state, in order to safely descend to the ground by moving mechanically little by little, it is necessary to release slightly the pressure applied to the rope 21.

Figure 5:
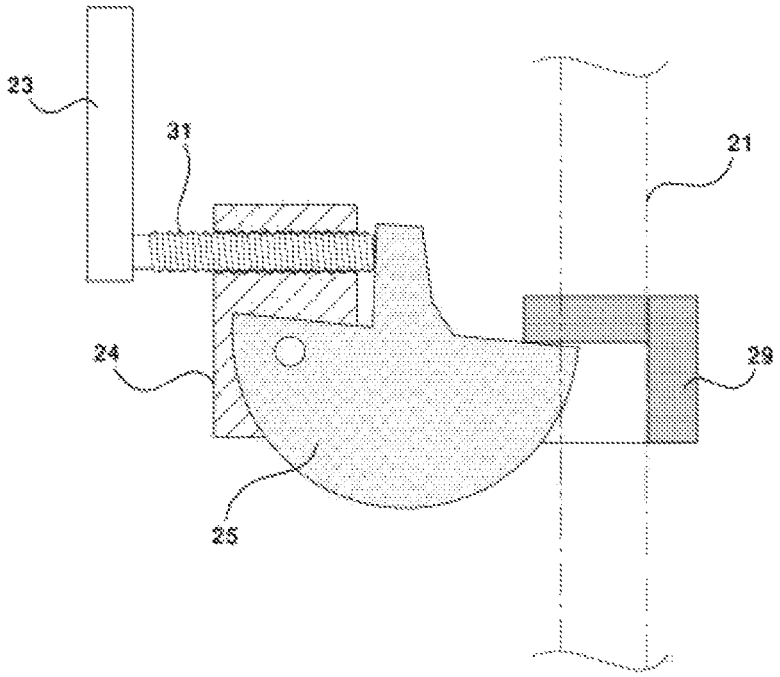
FIG. 5 is a cross-sectional view illustrating a locked state of the mechanical braking device in the rope type lifting device according to the present invention.
Figure 6:
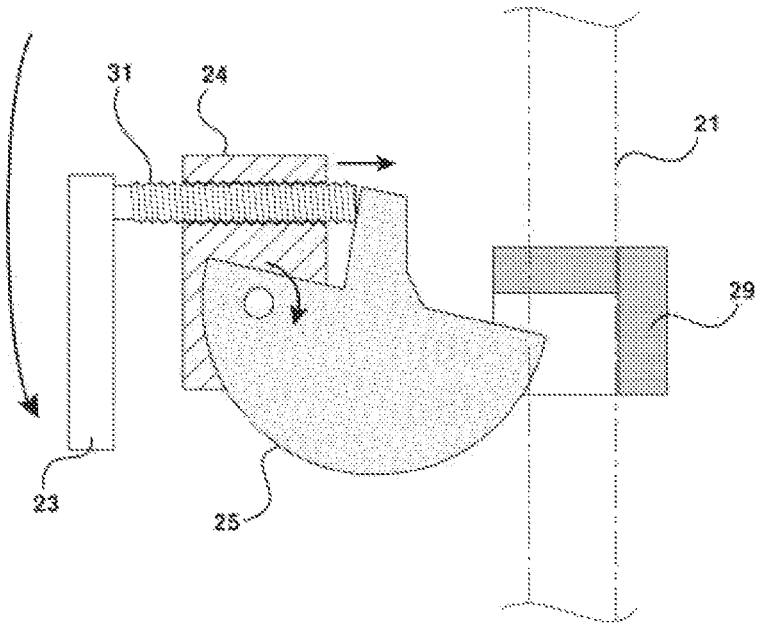
FIG. 6 is a cross-sectional view illustrating an unlocked state of the mechanical braking device in the rope type lifting device according to the present invention.

FIG. 5 is a cross-sectional view illustrating a locked state of the mechanical braking device in the rope type lifting device according to the present invention. FIG. 6 is a cross-sectional view illustrating an unlocked state of the mechanical braking device in the rope type lifting device according to the present invention.

As illustrated in FIG. 5, the mechanical braking device 9 of the present invention can mechanically press the rope 21 wound on the rope drum 19 to prevent movement. And the mechanical braking device 9 of the present invention, as illustrated in FIG. 6, can release the pressure of the rope 21 a little so that the rope can be moved by a predetermined amount.

A mechanical braking device 9 of the present invention comprises: a support part 24 for supporting the mechanical braking device 9 on a base (not shown) for supporting the entire device; an unlocking lever 23 rotated within the range of approximately 180 degrees from the upper side of the support part 24; and a rotating body 25 supported by the support part 24 and presses the rope 21 by the rotation of the unlocking lever 23.

And the mechanical brake of the present invention is configured to comprise a connecting portion 31 coupled to the unlocking lever 23, for advancing forward by a predetermined amount by the rotation of the unlocking lever to rotate the rotating body 25 in a clockwise direction by a predetermined amount, and a stopper 29 for limiting the rotation of the rotating body 25. Looking in more detail, the support part 24 is a configuration for fixing the mechanical braking device to the base. The support part 24 supports the mechanical braking device 9 entirely on the base.

As illustrated in FIGS. 5 and 6, the unlocking lever 23 is configured to be rotatable in a range of approximately 180 degrees from the upper side to the lower side. When the unlocking lever 23 is in the position of FIG. 5, it becomes a locked state, and when the unlocking lever 24 is in the position of FIG. 6, it becomes an unlocked state.

The connecting portion 31 is connected to the unlocking lever 23 so that when the unlocking lever 23 is rotated toward the lower side by 180 degrees, the rotating body 25 is rotated by a predetermined amount in a clockwise direction while advancing in an arrow direction.

Figure 7:
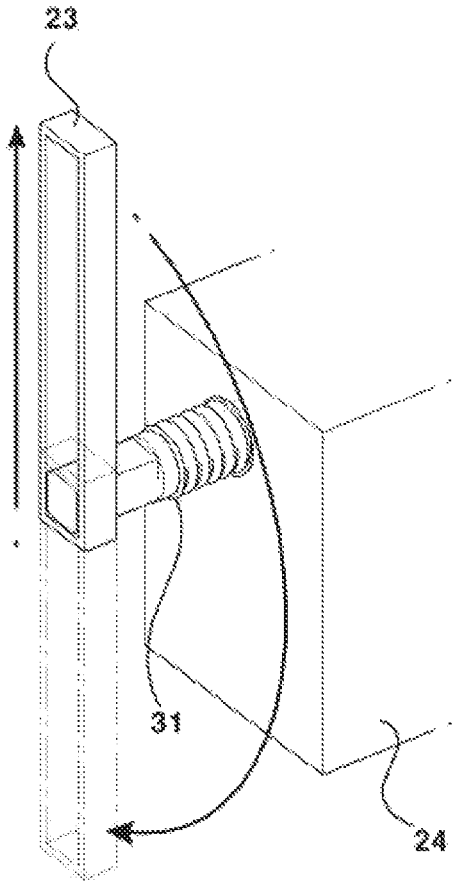
FIG. 7 illustrates a detailed configuration of the unlocking lever in the rope type lifting device according to the present invention.

FIG. 7 illustrates the relationship between the unlocking lever 23 and the connecting portion 31 in more detail.

The unlocking lever 23 is made of a shape in which slots are formed in the lengthwise direction, and a member inserted into the slots and rotated together with the unlocking lever 23 is shown as a connecting portion 31. That is, the unlocking lever is configured such that slots are formed in the lengthwise direction, and the unlocking lever can be moved up and down within the lengthwise direction of the slots.

That is, with the 180 degree rotation of the unlocking lever 23, the connecting portion which maintains the insertion state into the slots is rotated together, and in conjunction with this rotational operation, the fastening position of the screw thread of the connecting portion 31 is changed, and as a result, the front end portion of the connecting portion being engaged with the rotating body is advanced in the arrow direction by a predetermined advance.

When the unlocking lever 23 is rotated 180 degrees, as shown in FIG. 6, the position of the unlocking lever is moved to the lower side. In this state, when the unlocking lever 23 is pushed to the upper side through the slots of the unlocking lever 23, it becomes the initial state illustrated in FIG. 7 to enable the reciprocating rotation of the lever. That is, the configuration of the unlocking lever illustrated limits the rotation range of the lever within 180 degrees without a need to make a space for the lever to rotate, and it shows that the lever is returned to the initial state and the up and down movement is accomplished through the slots.

In addition, an important point in the interlocking operation of the connecting portion 31 and the rotating body 25 is that the amount of rotation in which the rotating body 25 is rotated clockwise is determined by the amount of advancement of the connecting portion 31. And the rotating body 25 is configured to reduce the pressing force applied to the rope 21 while being rotated clockwise by the amount of advance of the connecting portion 31, and as shown in FIG. 6, when the rotating body 25 is rotated in the clockwise direction, the pressing force applied to the rope 21 becomes a weakened state than the state shown in FIG. 5.

The stopper 29 fixedly mounted on the support part 24 or the base is configured to limit the amount of rotation of the rotating body 25 in the counterclockwise direction, and to support the pressing force applied to the rope 21 by the rotating body 25.

The stopper is configured to be a shape capable of passing a rope, and it becomes a state wherein the rotating body 25 presses the rope 21 passing through the stopper 29. And the rope 21 passing through the stopper 29 is wound around the rope drum 19 by one rotation, and it will have a state wherein the rope is moved from the upper side to the lower side or vice versa by the rotation of the rope drum 19. In the portion wherein a rotating body 25 is engaged with the rope 21, a sawtooth shape is formed toward the downward direction.

The mechanical braking device 9 of the present invention configured as described above is operated as follows.

The rope type elevating device of the present invention provides power for the lifting and descending operation as it is suspended from the rope 21, and at this time a person can be lifted or descended with the rope type elevating device.

However, when the electronic braking device 15 for controlling the lifting and descending operation by using the power of the rope type elevating device fails, the mechanical braking device 5 is forcibly controlled to a state as shown in FIG. 5 so as to stop the movement of the rope 21.

That is, the rotation of the rotating body 25 in the counterclockwise direction is limited by the stopper 29, and at this time, the rotating body 25 strongly presses the rope 21 configured to pass through the stopper 29, thereby suppressing the rope 21 from moving.

In this state, as shown in FIG. 6, when the unlocking lever 23 is rotated downward, the connecting portion 31 connected to the unlocking lever 23 is advanced by a predetermined amount in the direction of the arrow. In this state, as shown in FIG. 6, when the unlocking lever 23 is rotated downward, the connecting portion 31 connected to the unlocking lever 23 is advanced by a predetermined amount in the direction of the arrow. As the connecting portion 31 moves forward, the rotating body 25 is pushed, and the rotating body 25 is rotated clockwise by the amount of advancement of the connecting portion 31.

Due to this operation, the rotating body 25 is rotated in the clockwise direction within the limit of rotating range of the stopper 29, and the pressing force applied to the rope 21 from the rotating body 25 becomes a weakened state by a predetermined amount.

In this way, when the pressing force applied to the rope 21 is weakened by a predetermined amount, it is possible to descend little by little under the weight of the load consisting of the rope type elevating device and a person. Of course, the pressing force applied to the rope 21 in this process is reduced by a very small degree compared to FIG. 5. And since the tooth portion of the rotating body 25 engages with the rope 21, the movement of the rope is very limited. However, it is possible to come down to the ground little by little by the weight of the rope type lifting device and a person suspended in the air, and the gravity.

Therefore, if the process of repeatedly reciprocating the unlocking lever 23 within the range of 180 degrees, as the mechanical braking device is repeatedly switched from the locked state to the unlocked state, the rope is moving little by little so that it becomes possible to safely descend the rope type lifting device of the present invention to the ground.

Accordingly, the above detailed description should not be construed as limiting in all respects and should be considered as illustrative. The scope of the invention should be determined by reasonable interpretation of the appended claims, and all changes within the equivalent scope of the invention are included in the scope of the invention.

What is claimed is:

1. A rope type lifting device comprising an electronic braking device for winding a conveying rope to move the rope up and down by power, and a mechanical braking device for mechanically moving the conveying rope up and down, wherein the mechanical braking device comprises an unlocking lever rotated by an external force within a predetermined rotation range;

a connecting portion connected with the unlocking lever and moving forward by a predetermined amount in conjunction with the rotation of the unlocking lever;

a rotating body that rotates by the amount of moving forward of the connecting portion and adjusts a pressing force applied to the conveying rope;

a stopper limiting the rotation range of the rotating body and supporting the pressing force applied to the rope by the rotating body.

2. The rope type lifting device of claim 1, wherein the unlocking lever forms a slot in a lengthwise direction, and configured to be movable the unlocking lever up and down within the lengthwise direction of the slot.

3. The rope type lifting device of claim 1, wherein the stopper is configured a shape of passing a rope, and configured to press the rope passing the stopper by the rotating body.

4. The rope type lifting device of claim 3, wherein the rotating body is reciprocally rotated in conjunction with a rotational operation of the unlocking lever within the rotation range limited by the stopper.

* * * * *